US008033974B2

(12) United States Patent
Yeager

(10) Patent No.: US 8,033,974 B2
(45) **Date of Patent: *Oct. 11, 2011**

(54) METHOD OF FORMING A PACKAGE WITH A RECLOSEABLE POUR SPOUT

(75) Inventor: James W. Yeager, Mobile, AL (US)

(73) Assignee: Innoflex Incorporated, Mobile, AL (US)

( * ) Notice: Subject to any disclaimer, the term of this patent is extended or adjusted under 35 U.S.C. 154(b) by 46 days.

This patent is subject to a terminal disclaimer.

(21) Appl. No.: 12/573,528

(22) Filed: Oct. 5, 2009

(65) Prior Publication Data

US 2010/0086240 A1 Apr. 8, 2010

Related U.S. Application Data

(60) Continuation of application No. 12/283,973, filed on Sep. 17, 2008, now Pat. No. 7,597,657, which is a continuation of application No. 11/235,810, filed on Sep. 27, 2005, now Pat. No. 7,442,156, which is a division of application No. 10/413,806, filed on Apr. 15, 2003, now Pat. No. 6,971,794.

(51) Int. Cl.
*B31B 1/84* (2006.01)
*B65B 61/18* (2006.01)

(52) U.S. Cl. ..... 493/213; 493/927; 53/412; 53/133.4; 53/139.2

(58) Field of Classification Search ..... 53/412, 53/133.4, 139.2; 493/212–214, 927; 383/5, 383/63, 61.3, 64, 203, 204, 207; 156/66; 24/64; 29/408–410, 768
See application file for complete search history.

(56) References Cited

U.S. PATENT DOCUMENTS

| | | | | |
|---|---|---|---|---|
| 5,392,589 | A * | 2/1995 | Buchanan | 53/412 |
| 6,164,826 | A * | 12/2000 | Petkovsek | 383/210.1 |
| 2006/0034551 | A1* | 2/2006 | Linneweil | 383/61.2 |
| 2008/0044115 | A1* | 2/2008 | Ichikawa et al. | 383/204 |
| 2009/0180716 | A1* | 7/2009 | Steele | 383/26 |
| 2010/0202714 | A1* | 8/2010 | Koenigkramer | 383/63 |

* cited by examiner

*Primary Examiner* — Hemant M Desai
(74) *Attorney, Agent, or Firm* — Wood, Phillips, Katz, Clark & Mortimer

(57) ABSTRACT

A package having a recloseable pour spout is disclosed, with the package including front and rear package panels which may be joined at respective side edges thereof by inwardly extending side gussets. An upper edge portion of the package is removable, including one of the side gussets, to form a pour spout for dispensing the contents of the package. A fastener strip, which can be detachably connected to itself, extends between confronting inside surfaces of the front and rear package panels, adjacent to the pour spout, whereby the pour spout can be conveniently closed after the package is initially opened. A method of forming the present package is also disclosed.

5 Claims, 7 Drawing Sheets

METHOD OF FORMING A PACKAGE WITH A RECLOSEABLE POUR SPOUT

CROSS-REFERENCE TO RELATED APPLICATION

This application is a continuation of U.S. Ser. No. 12/283,973, filed Sep. 17, 2008, which is a continuation of U.S. Ser. No. 11/235,810, filed Sep. 27, 2005, which is a division of U.S. Ser. No. 10/413,806, filed Apr. 15, 2003, now U.S. Pat. No. 6,971,794, the disclosure of which is incorporated herein by reference.

TECHNICAL FIELD

The present invention relates generally to recloseable packages, and more particularly to a package having a recloseable pour spout, which can be configured to include side gussets, and which is particularly suited for use for packaging dry, pourable contents.

BACKGROUND OF THE INVENTION

Recloseable packages have come into increasingly widespread use in view of the convenience they provide to consumers and other users to permit a portion of a package's contents to be used, and the package effectively reclosed. To this end, packages have been provided with recloseable elements including profile fastener strips, cooperating adhesive strips, hook-and-loop fastener elements, and the like, to permit a package to be conveniently reclosed after its initial opening. U.S. Pat. Nos. 5,782,733, 4,655,862, 4,844,759, and 4,909,017, all hereby incorporated by reference, disclose various recloseable package constructions, and methods for effecting their formation.

Packages formed in accordance with the above-referenced patents typically include a package portion which is removable for initial opening of the package, and for providing access to a profile fastener strip or other type of recloseable element. In typical constructions known heretofore, the recloseable element of the package extends substantially completely across one dimension of the package, i.e., completely across the width of the package. Access to the package contents is thus facilitated.

For some applications, however, it can be desirable to maintain the sealed integrity of a portion of the package, while an associated portion of the package is configured for recloseable opening. Such an arrangement permits a package to be formed to include a pour spout, thus facilitating convenient pouring of the packages contents, such as dog food, fertilizer, dry cereal, or other dry, pourable materials. The present invention is directed to a package including a recloseable pour spout, which package can desirably be configured to include side gussets, thus desirably increasing the internal capacity of the package with efficient use of packaging materials.

SUMMARY OF THE INVENTION

The present invention is directed to a package including a pour spout that can be conveniently reclosed after the package is initially opened. Notably, the present package can be configured to include side gussets, providing the package with a configuration which provides the package with desired internal volume, and efficient use of packaging materials. A method of making the package is also disclosed, the disclosed method facilitating use of the package with high-speed form, fill, and seal (FFS) packaging machinery, for efficient and economical use.

In accordance with the illustrated embodiment, the present package includes a front package panel and a rear package panel, with the illustrated embodiment further including a pair of side gussets joining respective opposite edges of the front panel and the rear panel to each other. While the present package is illustrated as including side gussets, it will be understood that the present package may be configured without such side gussets, in a so-called "pillow pack" configuration.

The package of the present invention further includes a recloseable fastener strip extending from confronting inside surfaces of the front and rear package panels, that is, from a portion of an inside surface of the front panel to a portion of an inside surface of the rear panel. If the package is configured to include side gussets, the fastener strip extends along an inside surface of one of the gussets. The fastener strip may be provided in the form of a profile fastener strip, an adhesive fastener strip, or a hook-and-loop fastener strip, such that the fastener strip is configured for detachable connection to itself.

The front and rear panels, and the side gussets, if provided, are sealed to each other at an upper edge of the package to form a sealed header, a portion of which is removable to form a pour spout of the package. The removable portion of the header is positioned above and adjacent to the fastener strip of the package, with the fastener strip thus being positioned for reclosing the pour spout after initial package opening. This is easily effected by folding the fastener strip and connecting it to itself, thereby closing the pour spout of the package. While a portion of the sealed header of the package is removable, the remainder of the sealed header remains intact, thus maintaining the integrity of the package.

To facilitate opening of the removable portion of the sealed header, the package preferably includes at least one weakened region, such as provided in the form of scoring, perforations, or the like. If the package is provided with side gussets, the weakened region preferably extends through that one of the side gussets provided at that portion of the package providing the pour spout.

Efficient formation of the present package is achieved by providing a web of material having a longitudinal axis, and applying a plurality of fastener strips to the web of material at intervals corresponding to a length of each of the packages being formed. Each fastener strip extends transversely of the longitudinal axis of the web of material. As will be appreciated, a web of material having fasteners pre-applied thereto can be rolled and stored, and thereafter used in conjunction with a form, fill, and seal machine for completing package formation attendant to product filling. Alternatively, the present packages can be formed in a so-called "in-line" process, wherein the fastener strips are applied to the web of material as the material and strips are fed into a form, fill, and seal machine.

Package formation is effected by folding the web of material, and sealing the material to itself to form a tube. The tube is transversely sealed to form a series of packages in end-to-end relationship, with each package including a front package panel and a rear package panel. A respective one of the fastener strips extends from a portion of the front panel to a portion of the rear panel of the respective package, thereby forming the desired recloseable pour spout. A pair of inwardly extending side gussets can be formed in the tube prior to the transversely sealing step, with each fastener strip extending from the front panel to the rear panel of the respective package along an inside surface of a respective one of the side gussets.

The present package can be formed in alternative ways, depending upon the specific application. In one form, the web of material is sealed to itself generally along the rear panel of each package. Formation in this fashion includes application of a plurality of fastener strips to the web of material offset from the longitudinal axis thereof, whereby the desired pour spout is provided at an upper corner of each package being formed. Alternatively, the web of material can be sealed to itself generally along an edge of the front panel or rear panel of each package, such as at one of the side gussets, which can be desirable for providing an unseamed rear panel having suitable graphics or the like thereon. Formation in this manner can be effected by application of a plurality of fastening strips to the web of material in alignment with the longitudinal axis thereof, that is, with each of the fastener strips intersecting the longitudinal axis. Formation in this fashion can be desirable if packages are to be formed by pre-application of the fastener strips to the web of material, followed by forming a roll of the material for subsequent unrolling and use with a form, fill, and seal machine. The manner in which each fastener strip is positioned in alignment with the longitudinal axis of the web of material provides a "centered" disposition for the fastener strips, thus facilitating roll formation of the web of material with the pre-applied fastener strips.

Other features and advantages of the present invention will become readily apparent from the following detailed description, the accompanying drawings, and the appended claims.

DETAILED DESCRIPTION

Figure 1:
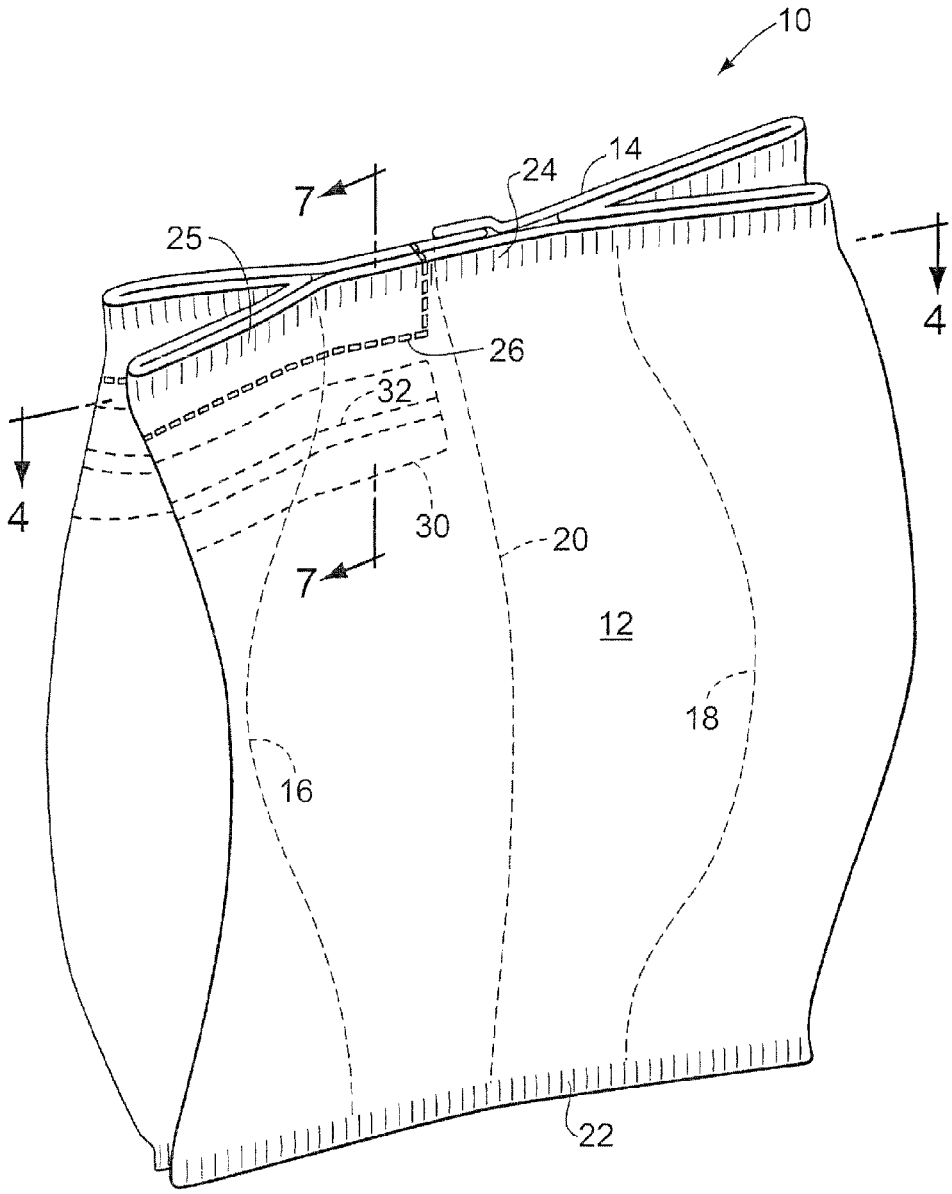
FIG. 1 is a perspective view of a package including a recloseable pour spout embodying the principles of the present invention, with the illustrated embodiment including side gussets.

While the present invention is susceptible of embodiment in various forms, there is shown in the drawings, and will hereinafter be described, a presently preferred embodiments of the invention, with the understanding that the present disclosure is to be considered as an exemplification of the invention, and is not intended to limit the invention to the specific embodiment illustrated.

The present invention discloses a package, which can be configured to include side gussets, wherein an upper corner of the package can be opened to form a pour spout. As will be further described, the package includes a fastener strip on the inside of the package which facilitates convenient reclosing of the pour spout after initial opening. A fastener strip is employed which is sufficiently flexible as to permit the package to assume a normal configuration before opening, with the fastener strip having a generally W-shape if the package includes side gussets. After initial package opening, a generally U-shaped pour spout is formed, with the now-exposed fastener strip on the inside of the package permitting the pour spout to be conveniently reclosed for subsequent pouring of the package contents. The present package is particularly suited for use for dry, pourable contents, such as dog food, dry cereal, fertilizer, and the like.

With particular reference to FIG. 1, the present package 10 can be suitably formed from a wide variety of materials, including plastic film, paper, laminate composites, and the like, as is well-known in the art. The package 10 includes a generally rectangular front package panel 12 and a generally rectangular rear package panel 14, which in the illustrated embodiment are joined to each other at respective opposite edges by a pair of inwardly extending side gussets 16 and 18. As will be appreciated, the package embodying the principles of the present invention can be provided without side gussets, with the respective edge portions of front panel 12 and rear panel 14 connected directly to each other, in the form of a so-called "pillow pack".

As will be further described, package 10 is formed from a web of material which is shaped into a tube, with the material joined to itself along a seam which extends along the length of the web of material. Package 10 thus includes a back seam 20, but it is within the purview of the present invention that the seam at which the web of material is joined to itself can be provided generally at the edge of one of the front or rear panels, with the seam thus being positioned generally within one of the side gussets 16, 18.

Package 10 is closed and sealed at upper and lower portions thereof by transverse seals. Bottom seal 22 joins front and rear panels 12 and 14 to each other, and to side gussets 16, 18. Depending upon the specific configuration which is desired, the side gussets can be sealed "closed" at the top and bottom seals, or can be left "open", as illustrated, that is, each of the side gussets forms a generally V-shape at the top and bottom of the package.

An upper transverse seal of the package 10 joins front panel 12 and rear panel 14 to each other, and to side gussets 16 and 18, and thus forms a sealed header 24 of the package 10.

In accordance with the present invention, an upper marginal corner portion 25 of package 10, including a portion of sealed header 24, is removable for forming a pour spout for the package 10. To this end, the package 10 is provided with a weakened region 26 at an upper corner of the package which facilitates removal of the portion 25 generally within the weakened region 26. Weakened region 26 may comprise suitable perforations, scoring such as by knife or laser, or other weakening of the region to facilitate convenient removal of the upper corner portion 25 of the package by a consumer. In the illustrated embodiment, weakened region 26 is shown as a series of perforations, with the weakened region extending into and through side gusset 16 which is disposed at that side of the package 10 at which the pour spout is provided.

Figure 2:
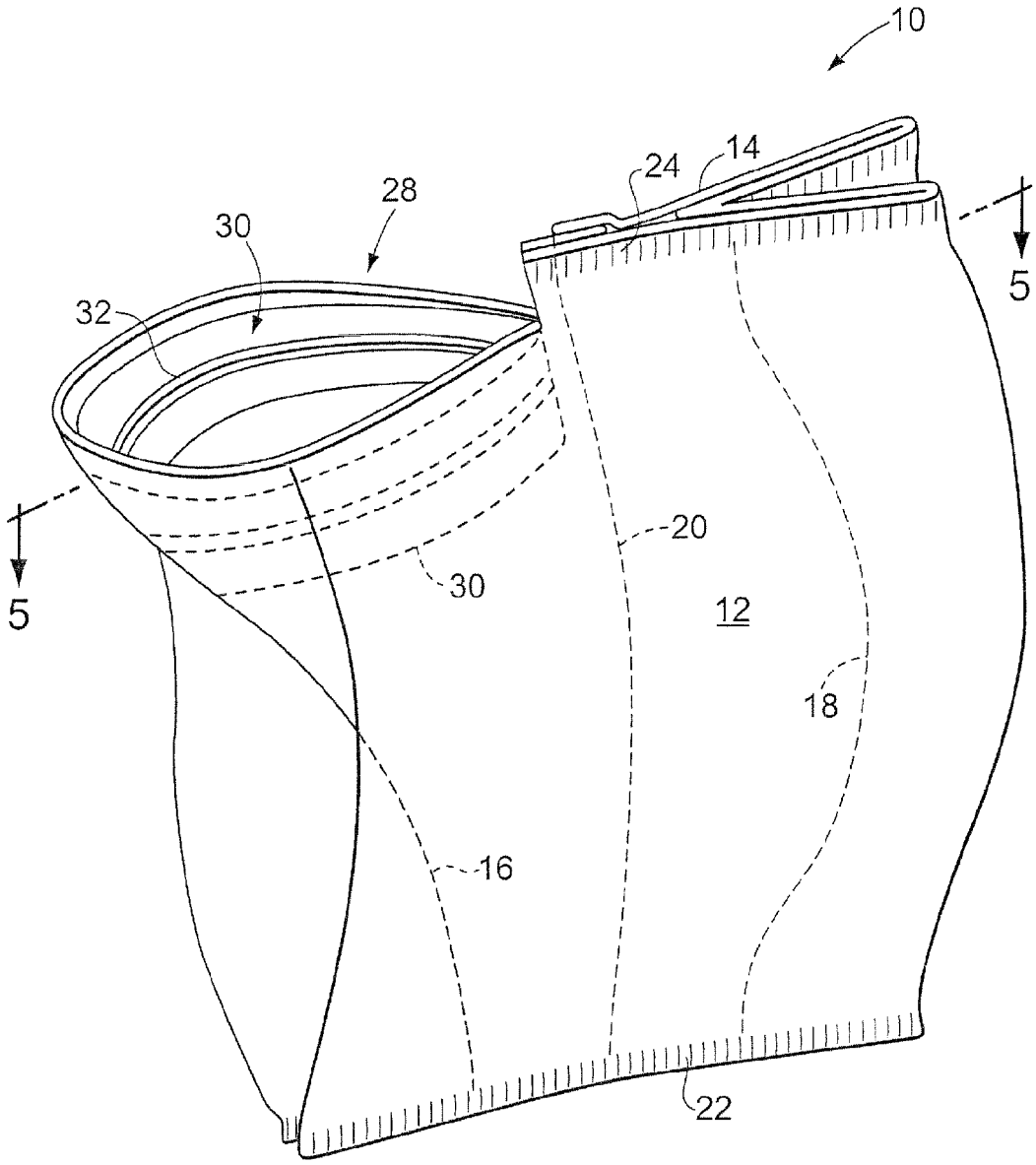
FIG. 2 is a perspective view of the package shown in FIG. 1 illustrating the package after the pour spout thereof has been opened.

FIG. 2 illustrates the present package 10 after fracture of weakened region 26, and removal of portion 25 of the package, including a portion of sealed header 24, to form a pour spout, generally designated 28. As will be observed, side gusset 16 is generally inverted or outwardly turned for formation of the pour spout 28, thus facilitating convenient dispensing of the contents of the package 10. As shown, the remaining portion of sealed header 14 remains intact, thus providing desired integrity for the package as it is manipulated to pour contents therefrom.

Figure 4:
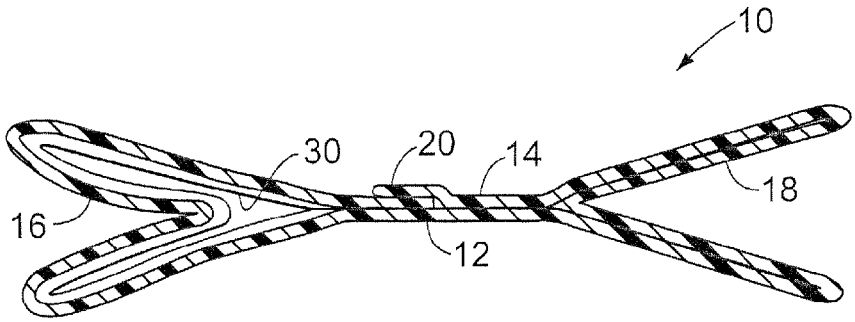
FIG. 4 is a cross-sectional view of the present package taken generally along lines 4-4 of FIG. 1.
Figure 5:
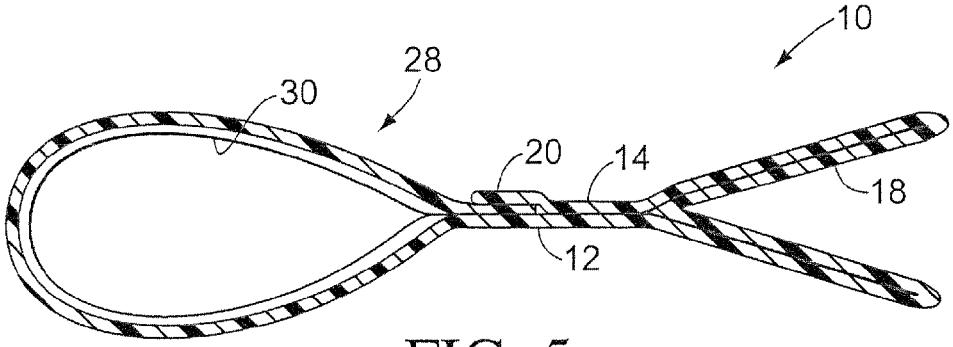
FIG. 5 is a cross-sectional view of the present package taken generally along lines 5-5 of FIG. 2.
Figure 6:
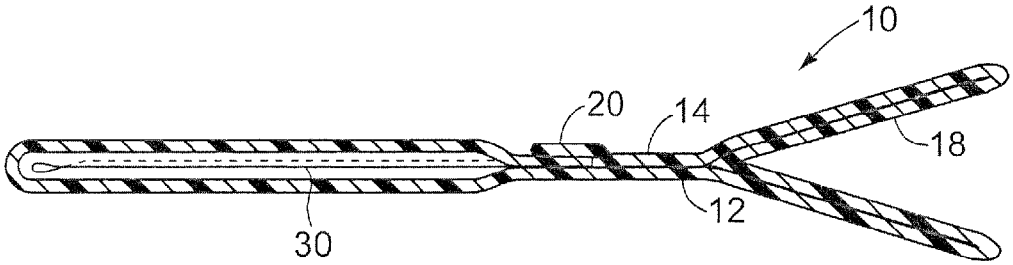
FIG. 6 is a cross-sectional view of the present package taken generally along lines 6-6 of FIG. 3.

In accordance with the present invention, convenient reclosing of pour spout 28 is effected by the provision of fastener strip 30 which is secured to the inside surface of the package 10. As illustrated, fastener strip 30 extends between confronting surfaces of front panel 12 and rear panel 14, that is, extends along a portion of the front panel and a portion of the back panel, generally beneath the pour spout 28 defined by weakened region 26 of the package, preferably generally along one side of the longitudinal centerline of the package. If the package 10 includes side gussets as illustrated, the fastener strip 30 extends along the inside surface of side gussets 16. By this arrangement, the fastener strip 30 has a generally W-shape prior to opening of the package (see FIG. 4), and assumes a generally loop-shape or U-shape after the pour spout has been opened (FIG. 5).

Figure 3:
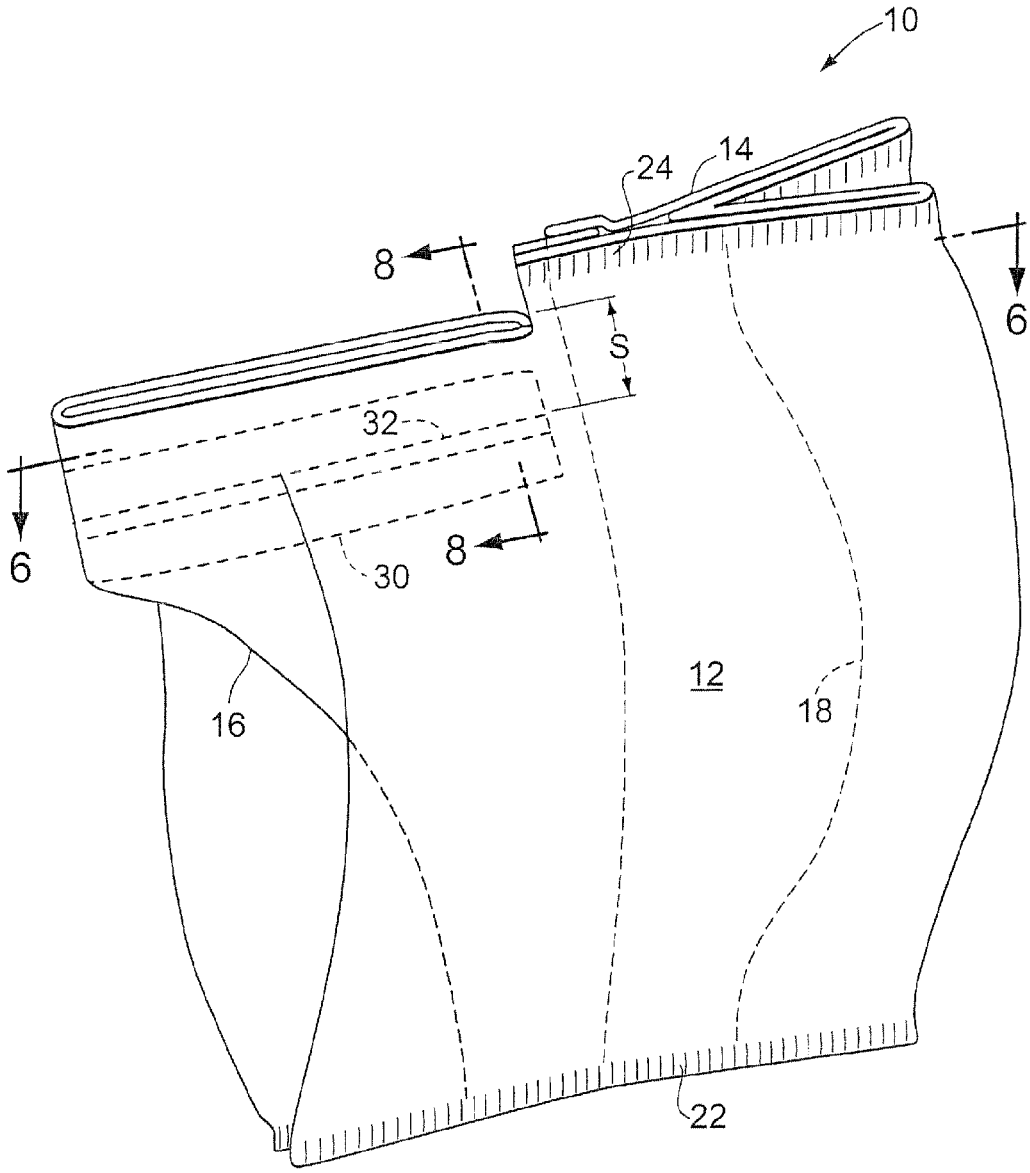
FIG. 3 is a view similar to FIGS. 1 and 2 illustrating the present package after the pour spout thereof has been closed.

Fastener strip 30 is configured for detachable connection to itself, and in this way facilitates convenient closing of the pour spout after the desired quantity of the contents of package 10 have been dispensed. The fastener strip is simply folded and pressed against itself, as illustrated in FIGS. 3 and 4, thus closing the pour spout 28. As will be observed, side gusset 16 is maintained in its outwardly extending disposition, thus facilitating detachable securement of the fastener strip 30 to itself substantially along its entire folded length. The package 10 is now effectively closed for subsequent reuse.

The specific configuration of fastener 30 can be varied while keeping with the principles disclosed therein. In one presently contemplated embodiment, the fastener strip 30 is provided in the form of a so-called profile fastener strip, which typically includes at least 2 upstanding elements which define a groove therebetween, such that the groove can receive one of the upstanding elements when the fastener strip is folded onto itself. U.S. Pat. Nos. 4,655,862, and 4,844,759, both hereby incorporated by reference, illustrate interlocking profile fastener strips which have the ability to lock onto themselves when the profile strip is folded. Such recloseable interlocking profile strips contain at least one "unisex" rib and groove locking feature.

Fastener strip 30 may alternatively be configured as an adhesive closure, such as disclosed in U.S. Pat. No. 4,898,787, hereby incorporated by reference. These types of adhesive closures include cold sealable, pressure-sensitive co-adhesive. This type of pressure sensitive closure exhibits a low surface tack and are co-adhesive only when placed under pressure in contact with other cold sealable, co-adhesive coated surfaces. The pressure-sensitive side of these types of cohesive closures can be folded so that the cohesive side is in contact with itself for use in a package embodying the present invention.

It is further contemplated that fastener strip 30 may be configured as a so-called hook-and-loop closure, as are known in the art. When configured in this form, the fastener strip may include two distinct portions, one having the so-called hook elements, and the other including the so-called loop elements, generally configured such that the strip can be folded at its midpoint and secured to itself throughout its folded length. Alternatively, a hook-and-loop fastener can be employed which includes elements throughout its length which can function as both "hooks" and as "loops", whereby the fastener strip 30 can be adhered to itself. For example, fasteners of this nature are known which include a plurality of closely-spaced, generally mushroom-shaped upstanding elements which are configured for detachable interengagement with like elements.

Figure 7:
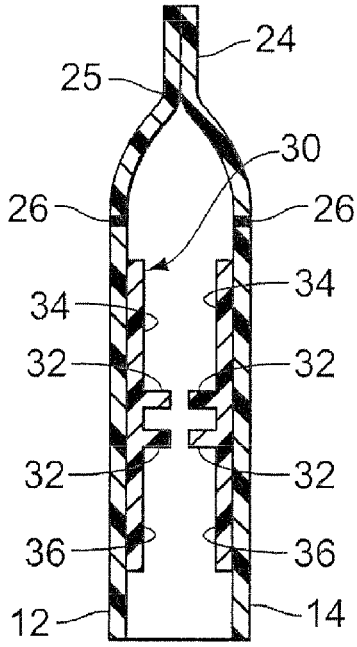
FIG. 7 is a fragmentary, cross-sectional view of the present package taken generally along lines 7-7 of FIG. 2.
Figure 8:
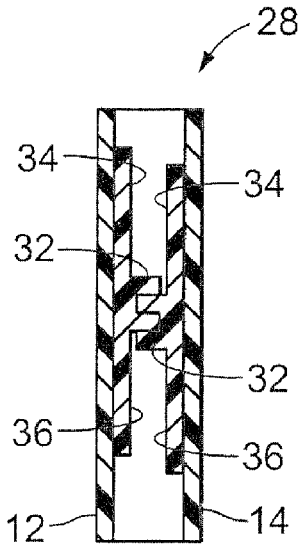
FIG. 8 is a fragmentary, cross-sectional view of the present package taken generally along lines 8-8 of FIG. 3.

In the illustrated embodiment, fastener strip 30 is shown as a flanged profile fastener strip, including profile elements 32 and upper and lower flange portions 34 and 36 (see FIGS. 7 and 8). Profile elements 32 may be formed separately from, or integrally with, flange portions 34, 36, with it presently preferred that the fastener strip 30 for the package 10 be configured as an integrated, single piece component for application to and disposition on the inside surface of the package.

As will be appreciated, profile elements 32 provide the attachment elements for detachable connection of the fastener strip 30 to itself, while upper and lower flange portions 34, 36 facilitate handling of each fastener strip, and securement to the associated web of material from which the package 10 is formed. In this regard, it is preferred that the profile elements 32, or the one or more attachment elements of a fastener strip 30 provided in another form, be positioned as closely as practicable to the sealed header 24 of the package, thus minimizing the unsealed region which exits between the header and the attachment element of the fastener strip. This spacing, designated S in FIG. 3, is preferably about 0.1875 inches to about 0.75 inches, thus providing sufficient space for forming equipment to form the necessary seal between upper flange portion 34 and the associated film material during package formation. To achieve this preferred spacing, the lower flange portion 36 may have a larger dimension than upper flange portion 34.

Figure 9:
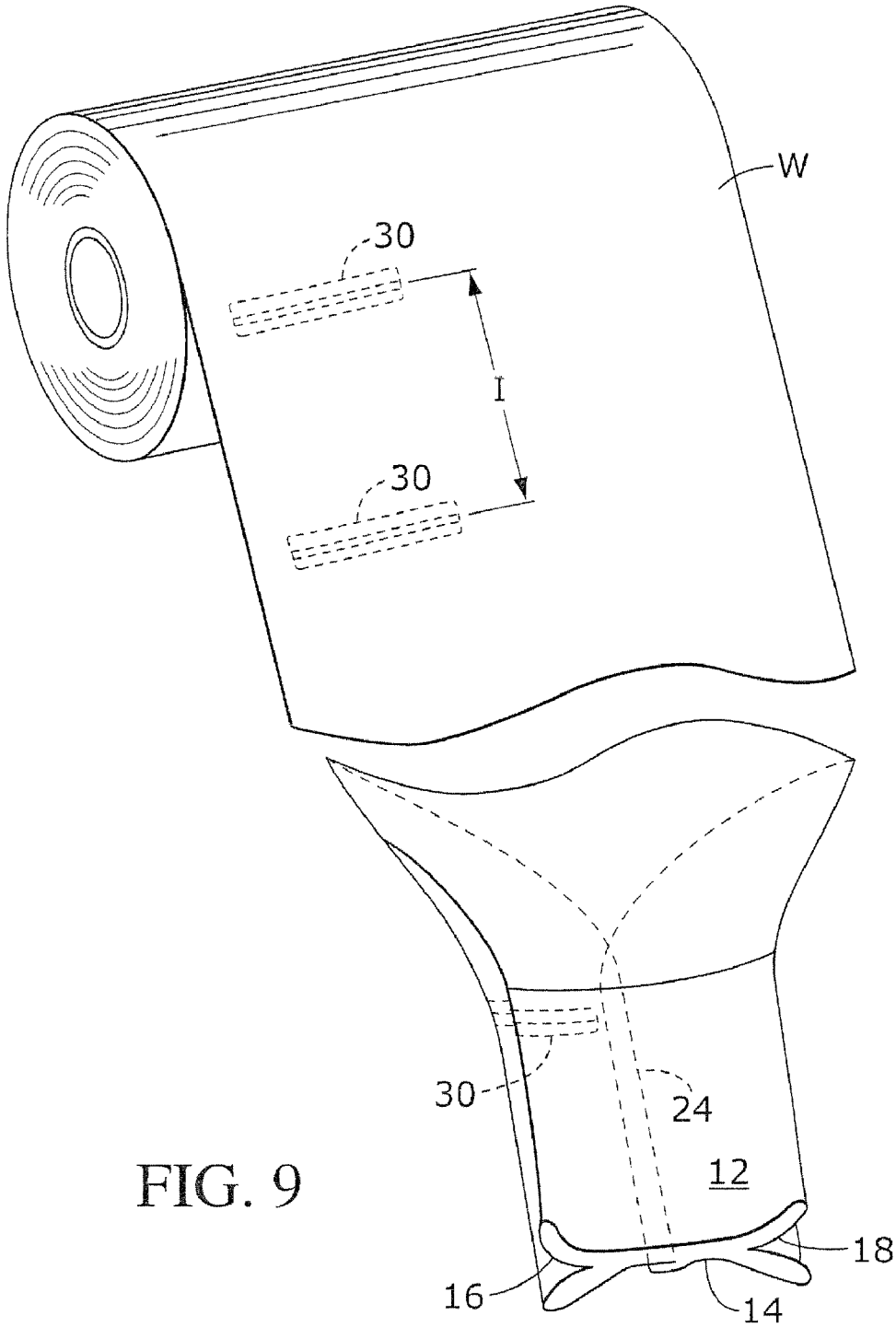
FIG. 9 is a diagrammatic perspective view illustrating formation of the present package.
Figure 10:
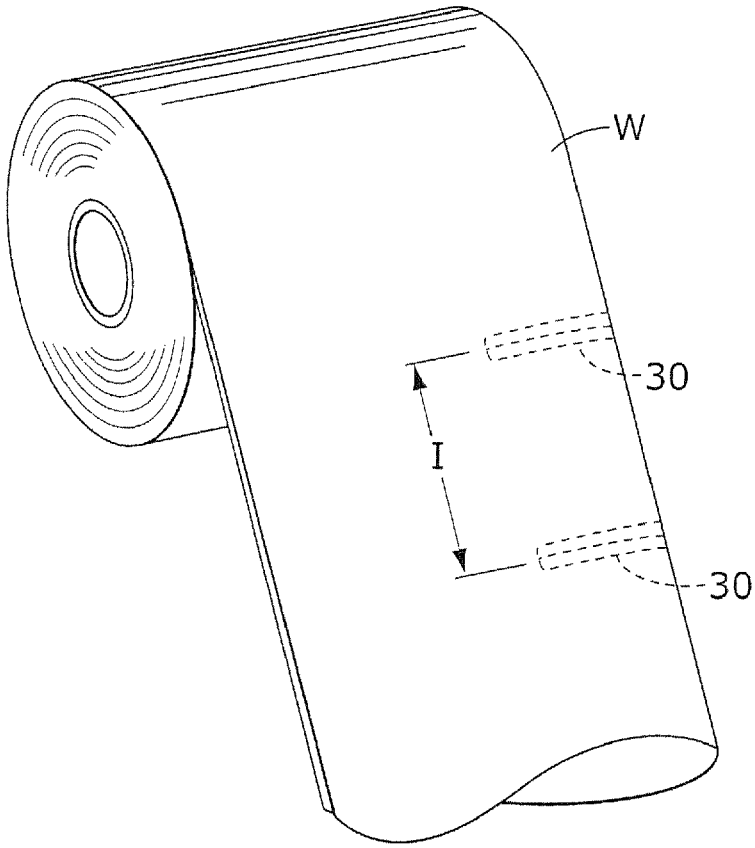
FIG. 10 is a diagrammatic perspective view illustrating a modified method of forming the package of the present invention.
Figure 10:
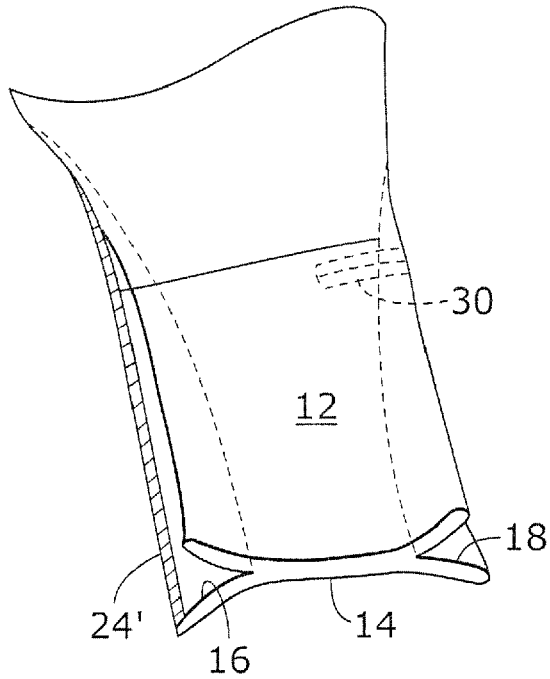

FIGS. 9 and 10 diagrammatically illustrate formation of the present package, which as noted above, can be effected by pre-application of fastener strips 30 to a web of material from which the package is formed, for subsequent use with a form, fill, and seal machine, or performed in-line with a form, fill, and seal machine.

A web of material W from which package 10 is formed, can be provided in roll form, and unwound so that the web of material defines a longitudinal axis. A plurality of the fastener strips 30 are provided, and are applied to the web of material W at intervals I which correspond to the length of each package being formed. As noted, each fastener strip 30 preferably is applied as a single piece of material during formation in this manner, even if each fastener strip itself comprises discrete portions, such as profile elements and associated flange portions.

After each fastener strip 30 is applied to the web of material so that it extends transversely of the longitudinal axis thereof, the web of material is folded, and sealed to itself to form a tube. In this fashion, back seam 20 is formed. The tube of material is transversely sealed to form a series of packages in end-to-end relationship, with each package including front and rear panels, as described above. As illustrated, a respective one of the fastener strips 30 extends from a portion of the front panel to a portion of the rear panel of the respective package, to thereby form the recloseable pour spout of the package. If the package is to be provided with side gussets, as illustrated, the web of material is guided with respect to suitable plows which form the side gussets prior to transverse sealing of the tube.

As illustrated in FIG. 9, the web of material W is sealed to itself generally along the rear panel 14 of each package being formed, with a plurality of fastener strips 30 applied to the web of material in offset relationship from the longitudinal axis thereof. In contrast, FIG. 10 illustrates formation of the package seam generally at one of the junction lines between the front and rear panels and the side gussets, that is, generally at one of the edges of the front and rear panels within the associated side gusset. If the present package is to be formed in this fashion, the plurality of fastener strips 30 are applied to the web of material in alignment with the longitudinal axis thereof, that is, generally intersecting the longitudinal axis. Formation in this fashion creates a package wherein the longitudinal seam thereof is not disposed on either the front or rear panel, thus facilitating display of graphics or the like on the panels. Additionally, when the fastener strips 30 are pre-applied to the web of material as illustrated in FIG. 10, such as for storage in roll form prior to use with a form, fill, and seal machine, disposition of the fastener strip generally at the centerline of the web of material provides a more stable roll of material.

As will be appreciated, creation of a package having a recloseable pour spout in accordance with the present invention contemplates that only a portion of the package, at which the pour spout is formed, be configured for reclosing. As such, fastener strips 30 need only extend along a portion of each of the front and rear panels of the package, and along the inside surface of one of the side gussets of the package, if side gusseted. Accordingly, each fastener strip has a length, when folded in half, which is less than one-half the width of the tube, in a flattened state, from which each package is formed.

Thus, a package which may be side gusseted is disclosed which includes a recloseable pour spout. Disposition of the fastener strip of the package adjacent to a removable portion thereof facilitates convenient opening and reclosing of the pour spout, as desired. When reclosed, the side gusset of the package need not be returned to its initial inward disposition, and thus the fastener strip of the package need not be returned to its initial W-shape. Prior to opening, it is presently preferred that the fastener strip not be attached to itself, thus facilitating convenient formation of the package pour spout after opening. However, for some applications it may be desirable for the W-shaped fastener strip to be secured to itself.

While it is preferred that the package 10 be provided with a weakened region 26 to facilitate opening, the provision of such a region is not required, since the package can be suitably opened such as by cutting with a scissors or knife. Again, it is contemplated that only a portion of the sealed header of the package be removed during opening, thus maintaining the remainder of the header intact for the integrity of the opened package.

From the foregoing, numerous modifications and variations can be effected without departing from the true spirit and scope of the novel concept of the present invention. It is to be understood that no limitations with respect to the specific embodiment disclosed herein are intended or should be inferred. The disclosure is intended to cover, by the appended claims, all such modifications as fall within the scope of the claims.

What is claimed is:

1. A method of forming a package with a recloseable pour spout, comprising the steps of:

providing a web of material having a longitudinal axis;

applying a plurality of fastener strips to said web of material at intervals corresponding to a length of each said package being formed, said fastener strips each extending transversely of said longitudinal axis and each being detachably connectable to itself;

folding said web of material, and sealing the material to itself to form a tube;

forming a pair of inwardly extending side gussets in said tube, each said fastener strip having a generally W-shape and extending from the front panel to the rear panel of the respective package along an inside surface of a respective one of said side gussets, and transversely sealing said tube to form a series of packages in end-to-end relationship, with each said package including a front package panel and a rear package panel, with a respective one of said fastener strips extending from a portion of the front panel to a portion of the rear panel and along an inside surface of one of said side gussets of the respective package to form a recloseable pour spout, said front and rear panels and said side gussets of each said package being sealed to each other to form a sealed header.

2. A method of forming a package in accordance with claim 1, wherein:

said web of material is sealed to itself generally along the rear panel of each said package.

3. A method of forming a package in accordance with claim 2, wherein:

said plurality of fastener strips are applied to said web of material offset from the longitudinal axis thereof.

4. A method of forming a package in accordance with claim 1, wherein:

said web of material is sealed to itself generally along an edge of said front panel or rear panel of each said package.

5. A method of forming a package in accordance with claim 4, wherein:

said plurality of fastener strips are applied to said web of material in alignment with the longitudinal axis thereof.

* * * * *